US008240281B2

(12) United States Patent
Akiyama et al.

(10) Patent No.: US 8,240,281 B2
(45) Date of Patent: Aug. 14, 2012

(54) HEAD COVER OF AN INTERNAL COMBUSTION ENGINE

(75) Inventors: Yoshihiro Akiyama, Wako (JP); Atsushi Yoshimura, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 37 days.

(21) Appl. No.: 12/527,811

(22) PCT Filed: Apr. 30, 2008

(86) PCT No.: PCT/JP2008/001121

§ 371 (c)(1),
(2), (4) Date: Jan. 7, 2011

(87) PCT Pub. No.: WO2008/139718

PCT Pub. Date: Nov. 20, 2008

(65) Prior Publication Data

US 2011/0061626 A1 Mar. 17, 2011

(30) Foreign Application Priority Data

May 16, 2007 (JP) ..... 2007-130265

(51) Int. Cl.
*F01M 9/10* (2006.01)
*F02B 77/00* (2006.01)

(52) U.S. Cl. ..... 123/90.38; 123/195 C

(58) Field of Classification Search ..... 123/90.38, 123/195 C, 198 E

See application file for complete search history.

(56) References Cited

FOREIGN PATENT DOCUMENTS

| | | |
|---|---|---|
| JP | 61-175514 U | 11/1986 |
| JP | 10-212924 A | 8/1998 |

OTHER PUBLICATIONS

Microfilm of the specification and drawings annexed to the request of Japanese Utility Model Application No. 59150/1985 (Laid-open No. 175514/1986) (Mazda Corp.) Nov. 1, 1986, p. 4, line 14 to p. 6, line 10; Figs. 1, 2.

*Primary Examiner* — Noah Kamen
(74) *Attorney, Agent, or Firm* — Arent Fox LLP

(57) ABSTRACT

A height of an upper end of an oil outflow prevention wall 25 with respect to the fastening plane 15 is greater in a lower side of the inclination of the fastening plane 15 than in a higher side of the inclination of the fastening plane 15.

7 Claims, 7 Drawing Sheets

HEAD COVER OF AN INTERNAL COMBUSTION ENGINE

TECHNICAL FIELD

The present invention relates to a head cover of an internal combustion engine, and particularly relates to a structure around an oil inlet of the head cover.

BACKGROUND ART

A head cover of an internal combustion engine is formed with an oil inlet through which lubricating oil is supplied to a valve mechanism, etc., and a cylindrical cap attachment boss to which an oil filler cap for closing the oil inlet can be detachably attached is formed around the oil inlet. Thus, the cylindrical cap attachment boss is formed on the head cover as a protrusion, and the oil inlet is formed inside of the attachment boss as an opening.

Some of such head covers are formed with an oil outflow prevention wall (barrier) that surrounds the cap attachment boss to define an oil trap portion around the cap attachment boss in order to prevent the oil that has been accidentally poured or spilt outside of the cap attachment boss when oil is supplied through the oil inlet from spreading over a wide area to contaminate a considerable portion of the head cover (see Japanese Utility Model Application Laid-Open Publication No. 61-175514, for example).

In some of the vehicles such as automobiles, an internal combustion engine (cylinder block) may be mounted transversely in such a manner that a cylinder axis is inclined with respect to a vertical line. Such an engine may be called an inclined engine. In the inclined engine, an upper surface of a cylinder head to which the head cover is fastened is inclined with respect to a horizontal plane, and hence the head cover is also inclined with respect to the horizontal plane in the installed state.

In this regard, in the conventional head cover, the upper end of the oil outflow prevention wall extends horizontally when the cylinder head is positioned horizontally. This can cause a problem in the inclined engine that in a lower side of the inclination, the oil spilt from the cap attachment boss can easily get over the oil outflow prevention wall to outside.

The higher the oil outflow prevention wall is, the harder the oil flows over the oil outflow prevention wall to outside. However, the higher the oil outflow prevention wall is, the more difficult it becomes to access the oil inlet to supply the oil and to attach or detach the oil filler cap to and from the attachment boss. Further, a higher oil outflow prevention wall can lead to a greater overall height of the engine and thus may compromise an advantage of the inclined engine that the inclined engine can assume a smaller height when installed in the vehicle.

BRIEF SUMMARY OF THE INVENTION

An object to be achieved by the present invention is to prevent the spilt oil from flowing to an undesired part in an inclined engine without compromising the easiness of oil supplying work as well as attachment and detachment of the oil filler cap.

The present invention provides a head cover of an internal combustion engine in which a fastening plane between the head cover and an engine main body is inclined with respect to a horizontal plane when the engine is mounted in a vehicle, the head cover comprising: a cap attachment boss to which an oil filler cap can be detachably attached, the cap attachment boss having an oil inlet inside thereof; and an oil outflow prevention wall formed around the cap attachment boss, wherein an oil trap portion surrounding the cap attachment boss is defined between the cap attachment boss and the oil outflow preventing wall, and wherein a height of an upper end of the oil outflow prevention wall with respect to the fastening plane becomes greater toward a lower side of the inclination of the fastening plane.

Also, the present invention provides a head cover of an internal combustion engine in which a fastening plane between the head cover and an engine main body is inclined with respect to a horizontal plane when the engine is mounted in a vehicle, the head cover comprising: a cap attachment boss to which an oil filler cap can be detachably attached, the cap attachment boss having an oil inlet inside thereof; and an oil outflow prevention wall formed around the cap attachment boss, wherein an oil trap portion surrounding the cap attachment boss is defined between the cap attachment boss and the oil outflow preventing wall, and wherein a height of an upper end of the oil outflow prevention wall with respect to the fastening plane is greater in a lower side of the inclination of the fastening plane than in a higher side of the inclination of the fastening plane.

In the head cover of an internal combustion engine according to the present invention, preferably, the oil outflow prevention wall comprises a part having a greater height than a height of the cap attachment boss in a lower side of the inclination of the fastening plane, and a part having a smaller height than the height of the cap attachment boss in a higher side of the inclination of the fastening plane.

In the head cover of an internal combustion engine according to the present invention, preferably, an upper end surface of the oil outflow prevention wall extends substantially horizontally in an installed state in the vehicle.

In the head cover of an internal combustion engine according to the present invention, preferably, a part of the oil outflow prevention wall is provided with an oil discharge opening.

In the head cover of an internal combustion engine according to the present invention, preferably, a bottom of the oil trap portion is provided with a downward slope toward the oil discharge opening in an installed state in the vehicle.

In the head cover of an internal combustion engine according to the present invention, preferably, the cap attachment boss is formed in a vicinity of one end of the head cover with respect to a crankshaft direction, and the oil outflow prevention wall comprises a part that extends along an edge of the one end of the head cover.

[Effects of the Invention]

In the head cover of an internal combustion engine according to the present invention, because the oil outflow prevention wall has a greater height in the lower side of the inclination, where the oil tends to flow out, than in the higher side of the inclination in an inclined engine, it is difficult for the oil to get over the oil outflow prevention wall to outside and thus outflow of oil to an undesired part can be prevented. Further, because the part of the oil outflow prevention wall in the higher side of the inclination has a smaller height than in the lower side of the inclination, favorable workability can be ensured in supplying oil and attaching/detaching the oil filler cap.

Particularly, in the structure where the oil outflow prevention wall comprises a part having a greater height than a height of the cap attachment boss in a lower side of the inclination of the fastening plane (i.e., in a region where the oil tends to flow out), and a part having a smaller height than the height of the cap attachment boss in a higher side of the inclination of the fastening plane (i.e., in a region where the oil is difficult to flow out), it is possible to favorably achieve both of prevention of oil outflow to an undesired part and easy attachment/detachment of the oil filler cap.

In the case where an upper end surface of the oil outflow prevention wall extends substantially horizontally in an installed state in the vehicle, it is possible to eliminate a part in the oil outflow prevention wall where the oil can easily get over, and thereby prevent the oil from flowing out to an undesired part when the head cover is inclined in the installed state in the vehicle.

Further, in the case that the oil outflow prevention wall is provided with an oil discharge opening in a part thereof, it is possible to desirably set a position at which the oil flows out from the oil trap portion to outside by properly selecting the position of the oil discharge opening, to thereby ensure that the oil is prevented from flowing out to an undesired part, i.e., a part where the oil should be avoided or where it is difficult to wipe out the oil, such as a portion where the timing belt is disposed. Further, when the bottom of the oil trap portion is provided with a downward slope toward the oil discharge opening in an installed state in the vehicle, the discharge of oil from the oil discharge opening can be achieved smoothly and reliably.

In the structure where the cap attachment boss is formed in the vicinity of one end of the head cover with respect to the crankshaft direction and the oil outflow prevention wall comprises a part extending along an edge of the crankshaft-wise end of the head cover, the rigidity of the end portion of the head cover can be improved and the improved rigidity can result in a better sealing surface pressure of the head cover.

BRIEF DESCRIPTION OF THE DRAWINGS

Now the present invention is described in the following with reference to the appended drawings, in which.

DETAILED DESCRIPTION OF THE PREFERRED EMBODIMENTS

Now, an embodiment of a head cover of an internal combustion engine according to the present invention will be described hereinafter with reference to FIGS. 1-5.

Figure 1:
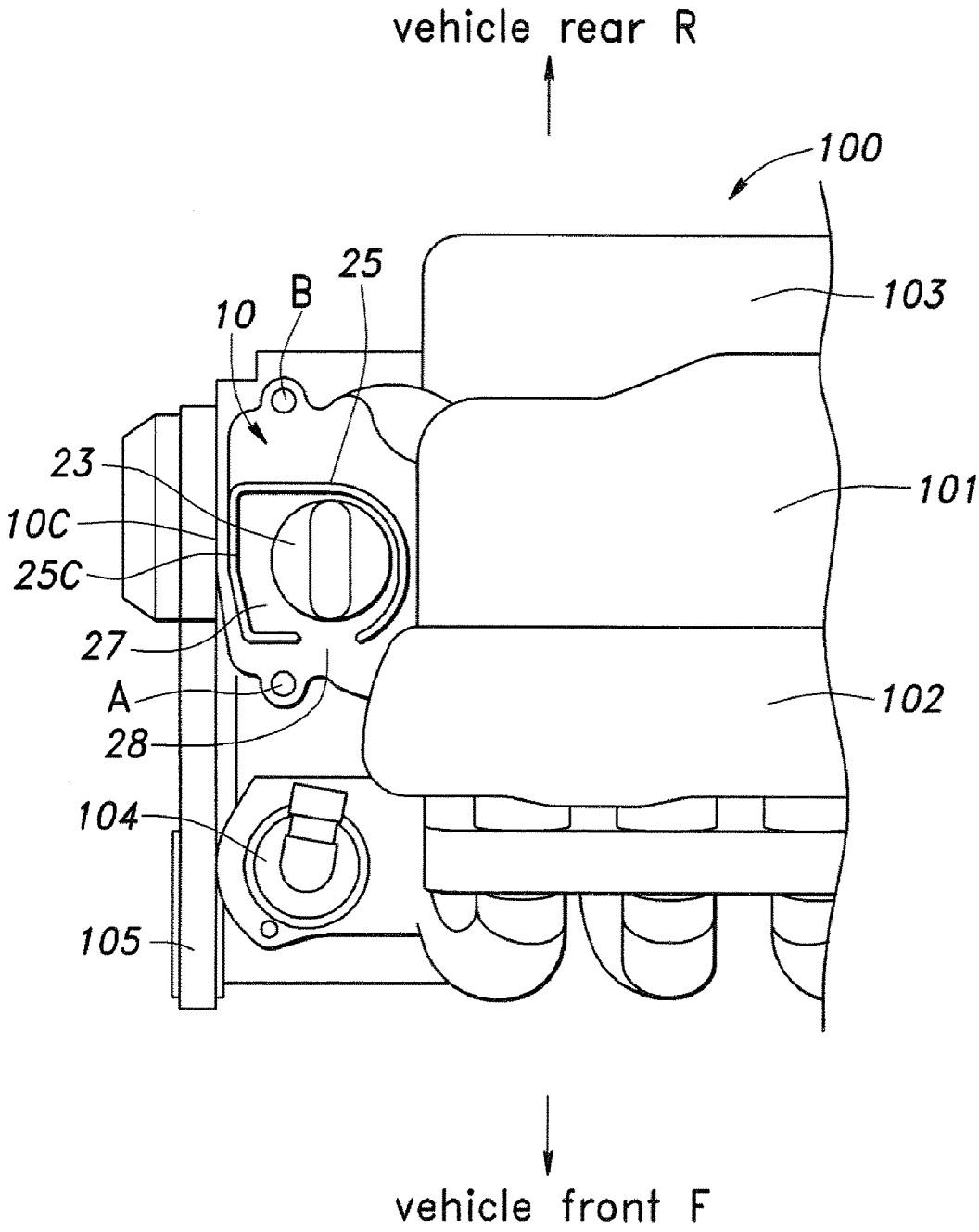
FIG. 1 is a plan view showing an essential part of an internal combustion engine comprising a head cover according to the present invention.
Figure 2:
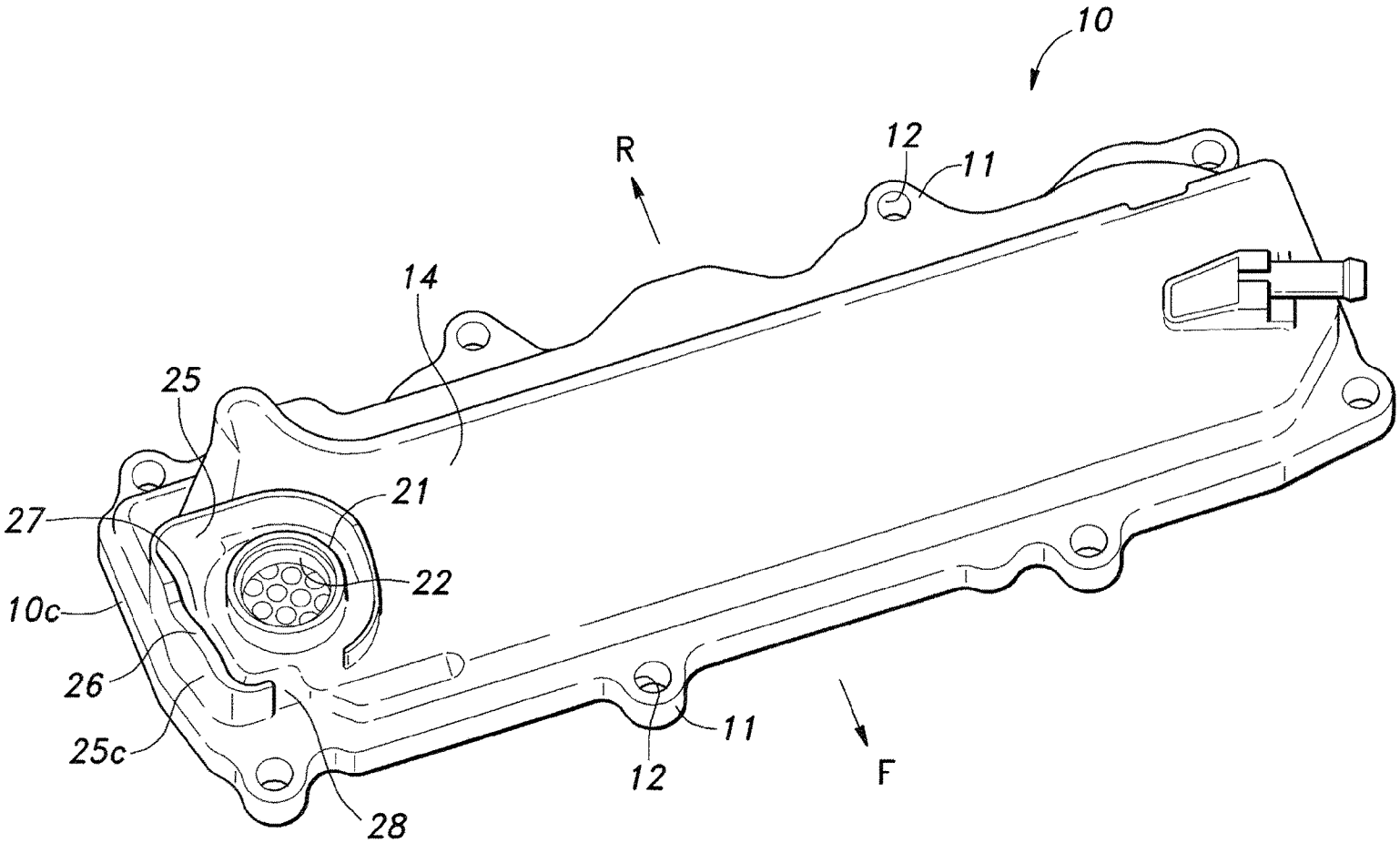
FIG. 2 is a perspective view showing an embodiment of a head cover according to the present invention.

FIG. 1 is a plan view showing an essential part of an internal combustion engine 100 having a head cover 10 according to this embodiment. The engine 100 consists of a straight four-cylinder gasoline engine, and is mounted transversely in a vehicle. In FIG. 1, a lower side of the sheet corresponds to a vehicle front F while an upper side of the sheet corresponds to a vehicle rear R. The engine 100 is a rearward inclined engine in that a part on a side of the head cover 10 (engine upper part) is inclined toward the vehicle rear R around a crankshaft axis. An angle θ (see FIG. 5) of the rearward inclination of the engine 100 can be about 5-10 degrees.

In FIG. 1, a reference numeral 101 indicates an intake surge tank disposed over the head cover 10, 102 indicates an intake manifold disposed on a side of the vehicle front F, 103 indicates an exhaust manifold disposed on a side of the vehicle rear R, and 105 indicates a timing belt disposed at an engine end (one end of the engine in a direction of cylinder arrangement) to drive an auxiliary machinery and the like.

The head cover 10 consists of a lid-like member longitudinal in the direction of cylinder arrangement of the engine 100, and is made by molding a resin material such as glass-fiber reinforced polyamide resin. The head cover 10 is securely fastened to an upper surface of a cylinder head 106 by means of fastening bolts 13 passed through corresponding through holes 12 defined in bolt boss portions 11 which are formed at a plurality of locations along an outer periphery of the head cover 10. As a result, when installed in the vehicle, a fastening plane 15 between the head cover 10 and the cylinder head 106 constituting an engine main body is inclined with respect to a horizontal plane h with the rearward inclination angle θ (see FIG. 5).

The head cover 10 is formed with a cylindrical cap attachment boss 21 in one end portion in the direction of cylinder arrangement, and more specifically in an end portion of an upper surface 14 on the same side as the timing belt 105 and on the side of the vehicle front F. The cap attachment boss 21 has an oil inlet 22 inside of it. The oil inlet 22 consists of a round opening extending through the upper surface 14 of the head cover 10 in a vertical direction.

The cap attachment boss 21 is adapted so as to be detachably attached with an oil filler cap 23 (see FIG. 1) for closing the oil inlet 22. In the case that the oil filler cap 23 is of a screw type, the cap attachment boss 21 is formed with a cap engaging threads 24 in its inner peripheral surface.

The upper surface 14 of the head cover 10 is also formed with an oil outflow prevention wall 25 which protrudes from the upper surface 14 so as to surround the cap attachment boss 21. Between the cap attachment boss 21 and the oil outflow prevention wall 25 is defined an oil trap portion 27 that surrounds the cap attachment boss 21. It should be noted that the cap attachment boss 21 and the oil outflow prevention wall 25 are integral parts of the head cover 10.

Figure 5:
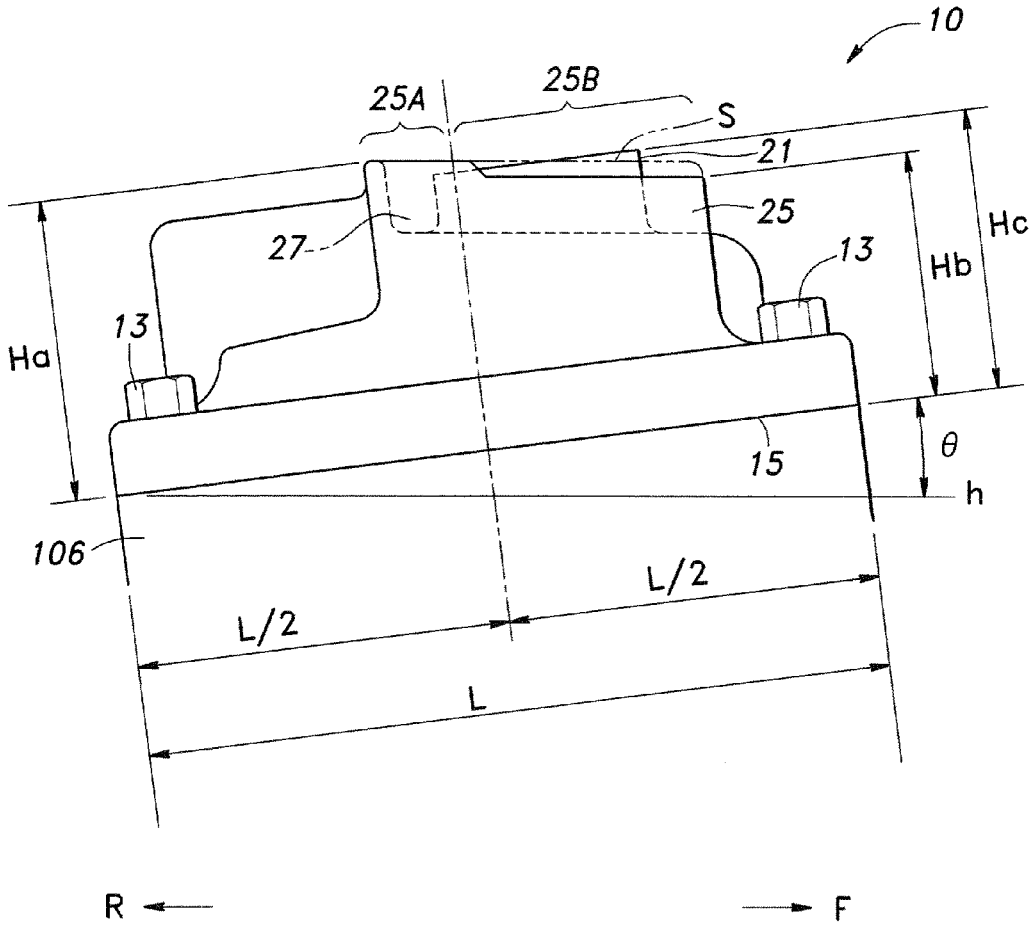
FIG. 5 is an enlarged plan view of an essential part of the head cover according to the embodiment.

One thing that is important in the head cover 10 of the illustrated embodiment is that a height of an upper end of the oil outflow prevention wall 25 with respect to the fastening plane 15 becomes greater toward a lower side of the inclination of the fastening plane 15 (toward left side in FIG. 5 or toward vehicle rear R). In other words, the height of the upper end of the oil outflow prevention wall 25 with respect to the fastening plane 15 is greater in a lower side of the inclination of the fastening plane 15 than in a higher side of the inclination of the fastening plane 15. In FIG. 5, the largest wall height in the lower side of the inclination is indicated by Ha, while the smallest wall height in the higher side of the inclination is indicated by Hb. It should be also noted that an upper end surface 26 of the oil outflow prevention wall 25 extends substantially in the horizontal direction in an installed state in the vehicle.

In addition to the above, the oil outflow prevention wall 25 comprises a part (high wall part) 25A having a greater height than a height He of the cap attachment boss 21 in a lower side of the inclination of the fastening plane 15, and a part (low wall part) 25B having a smaller height than the height He of the cap attachment boss in a higher side of the inclination of the fastening plane 15.

In this embodiment, at least part of the oil outflow prevention wall 25 that is on the side of vehicle front F (on the higher side of the inclination) with respect to the center of the cap attachment boss 21 has a smaller height than the height He of the cap attachment boss 21, and at least part of the oil outflow prevention wall 25 that is on the side of vehicle rear R (on the lower side of the inclination) with respect to the center of the cap attachment boss 21 has a greater height than the height He of the cap attachment boss 21, where the heights are measured from the fastening plane 15.

Figure 4:
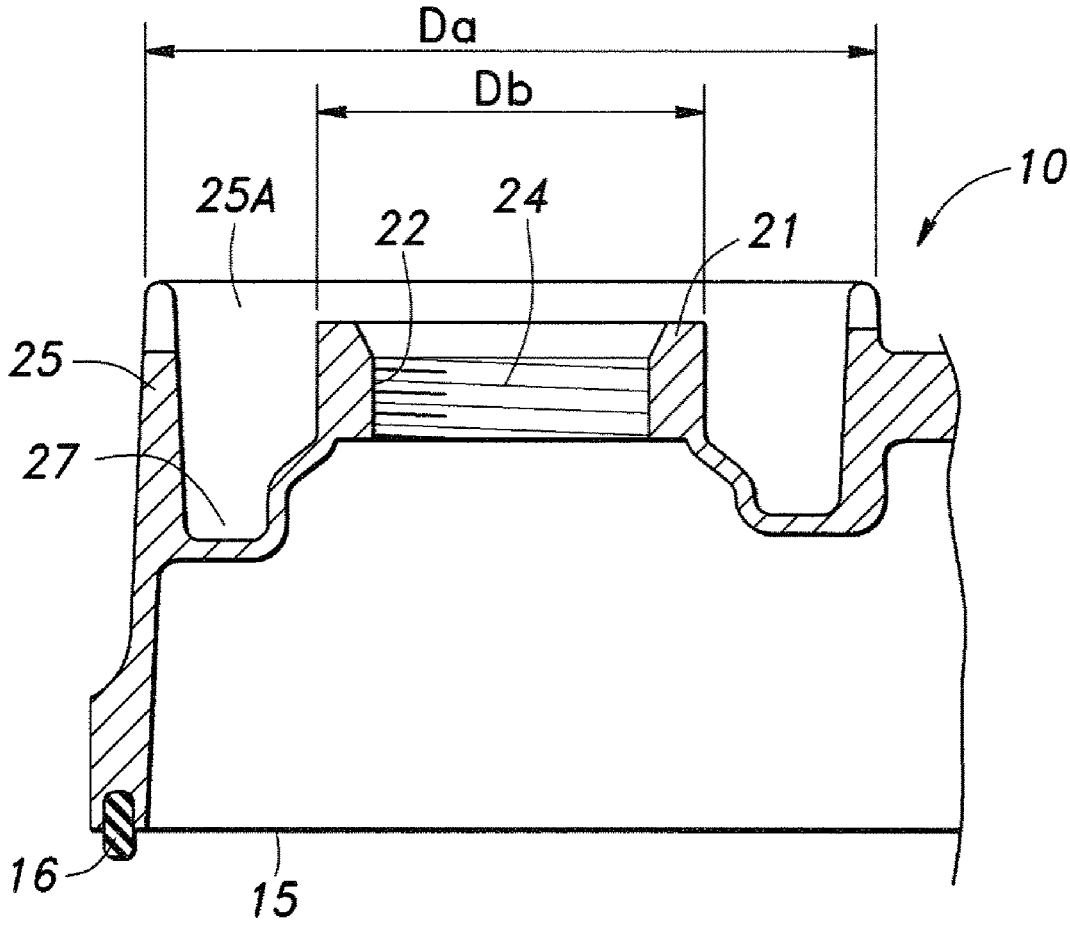
FIG. 4 is a cross-sectional view taken along the line IV-IV in FIG. 3.

As indicated by a reference numeral Da in FIG. 4, the high wall portion 25A of the oil outflow prevention wall 25 in the present embodiment extends over a greater range than an outer diameter Db of the cap attachment boss 21 on the side of the vehicle rear R. (lower side of the inclination) with respect to the cap attachment boss portion 21.

Further, in this embodiment, more than a half of the oil outflow prevention wall 25 surrounding the cap attachment boss 21 belongs to the low wall portion 25B. Specifically, all of the part of oil outflow prevention wall 25 that is on the side of the vehicle front F (upper side of the inclination) with respect to the center of the cap attachment boss 21 and a part of the oil outflow prevention wall 25 that is slightly on the side of vehicle rear R (lower side of the inclination) constitute the low wall portion 25B. It should be noted that a step is formed at a connection between the high wall portion 25A and the low wall portion 25B which have different heights.

Because the height of the oil outflow prevention wall 25 is set as above, specifically, the oil outflow prevention wall 25 is given a greater height in the lower side of the inclination, where the outflow of oil is likely to take place, than in the higher side of the inclination, it is difficult for the spilt oil to get over the oil outflow prevention wall 25 to undesired parts such as those on the side of vehicle rear R. Further, because the part of the oil outflow prevention wall 25 in the higher side of the inclination has a smaller height than in the lower side of the inclination, favorable workability can be ensured in supplying oil from the side of vehicle front F and attaching/detaching the oil filler cap.

A part of the oil outflow prevention wall 25 is formed with an oil discharge opening 28. In this embodiment, the oil discharge opening 28 is provided in a part of the oil outflow prevention wall 25 on the side of vehicle front F (upper side of the inclination) so that when the spilt oil flows out, it flows to a space between the intake manifold 102 and an exhaust gas recirculation valve 104, where the space serves as a desired part. In this way, the work for wiping out the spilt oil can be conducted easily from the side of vehicle front F, and this contributes to improvement in maintainability. In addition, contamination of the timing belt 105 by the spilt oil can be avoided.

The bottom of the oil trap portion 27 is provided with a downward slope (slant) toward the oil discharge opening 28 so that the spilt oil is caused to flow toward the desired part smoothly through the oil discharge opening 28.

The oil outflow prevention wall 25 comprises a part 25C that extends along an edge 10C of one end of the head cover 10 with respect to the crankshaft direction. This part 25C also serves as a reinforcement rib for increasing the rigidity of the head cover 10. Thus, in addition to protect the oil filler cap 23 attached to the cap attachment boss 21, the part 25C is effective in improving the rigidity of the side edge of the head cover 10 and hence in increasing the sealing pressure provided by the fastening bolts 13 along a portion between widthwise-apart fastening points A and B (see FIG. 1).

A seal member 16 made of an elastic material is provided on the fastening plane 15 of the head cover 10 so as to extend along an outer periphery of the head cover 10. The above part 25C of the oil outflow prevention wall 25 is positioned substantially right above a part of the seal member 16 that extends along the crankshaft-wise end 10C of the head cover 10.

In this embodiment, the part 25C extends between the two fastening points A and B of the head cover 10, and is formed over a length equal to or greater than at least a half (L/2) of the length L of the side edge of the head cover 10 in the direction of connecting the two fastening points A and B so that the length is larger than an outer diameter of the filler cap attachment boss 21. In order to effectively serve as a reinforcing rib for improving the rigidity, the part 25C is provided with a larger thickness compared to other part of the oil outflow prevention wall 25.

The beneficial effects of the head cover 10 of the present embodiment can be summarized as follows:

(1) Because the oil outflow prevention wall 25 has a greater height in the lower side of the inclination, where the oil spilt from the cap attachment boss 21 tends to flow out, than in the higher side of the inclination where the oil is difficult to flow out, it is possible to prevent the spilt oil from flowing to an undesired part when the head cover 10 is inclined in the state that the engine 100 is mounted in the vehicle.

(2) In the case where the fastening plane 15 between the head cover 10 and the engine main body is inclined in the installed state in the vehicle, at least part of the oil outflow prevention wall 25 that is on a front side with respect to the center of the cap attachment boss 21, to which the oil filler cap 23 is attached, is given a smaller height than the cap attachment boss 21, and at least part of the oil outflow prevention wall 25 that is on a rear side with respect to the center of the cap attachment boss 21 is given a larger height than the cap attachment boss 21. Thus, by providing a greater height to the portion of the oil outflow prevention wall 25 on the rear side, where the oil tends to flow out, than the cap attachment boss 21, it is possible to prevent the spilt oil from flowing out to an undesired part. Further, by providing a smaller height to the portion of the oil outflow prevention wall 25 on the front side, where the oil is hard to flow out, than the cap attachment boss 21, it is possible to easily attach/detach the oil filler cap from the front side, to thereby improve the maintainability.

(3) The oil discharge opening 28 provided in the front part of the oil outflow prevention wall 25 and the forwardly downward slope constituting the bottom of the oil trap space (oil trap portion 27) defined between the cap attachment boss 21 and the oil outflow prevention wall 25 allows the spilt oil to be guided and discharged to the front side. Therefore, it can be ensured that the oil is prevented from flowing out to a part where the oil should be avoided or where it is difficult to wipe out the oil such as a part where the timing belt is disposed.

(4) By making the upper end surface 26 of the oil outflow prevention wall 25 extend substantially horizontally in the installed state in the vehicle, it is possible to eliminate a part in the oil outflow prevention wall 25 where the oil can easily get over, and thereby prevent the oil from flowing out to an undesired part when the head cover 10 is inclined in the installed state in the vehicle.

(5) In the case where the cap attachment boss 21 is formed in a portion that is on the higher side of the inclination of the fastening plane 15 of the head cover 10 with respect to the center of the head cover 10 and near one end in the crankshaft direction, it is possible to constitute the oil outflow prevention wall 25 as a protruding rib (part 25C) extending substantially along the edge 10C of the one end of the head cover 10, to whereby improve the rigidity of the portion around the edge 10C of the head cover 10, and the improved rigidity can result in a better sealing surface pressure of the head cover 10. The protruding rib has a greater height around the central portion of the head cover 10, and therefore, the protruding rib for preventing the oil outflow can also serve effectively as a rib for protecting the oil filler cap 23 as well as a rib for improving the rigidity of a portion around the oil filler cap. This can eliminate the need for providing a reinforcement rib or protection rib around the oil filler cap in addition to the oil outflow prevention wall 25, and thus simplify the structure and reduce the cost.

It should be noted that the illustrated layout of the head cover 10 and shape of the oil outflow prevention wall 25 are just an example, and the present invention should not be limited to the illustrated embodiment. In the above embodiment, a step is provided in the oil outflow prevention wall 25 to accommodate a large difference in height between the portions of the oil outflow prevention wall 25 on the front and rear sides of the oil filler cap, but as shown by phantom lines S in FIG. 5, the upper end of the oil outflow prevention wall 25 may extend substantially straight smoothly. Further, the upper end surface of the oil outflow prevention wall 25 does not have to be accurately horizontal but may be approximately horizontal. The cap attachment boss 21 may not be limited to the one that extends vertically with respect to the fastening plane of the head cover 10, and may be inclined forward, for example, to improve the maintainability.

Figure 3:
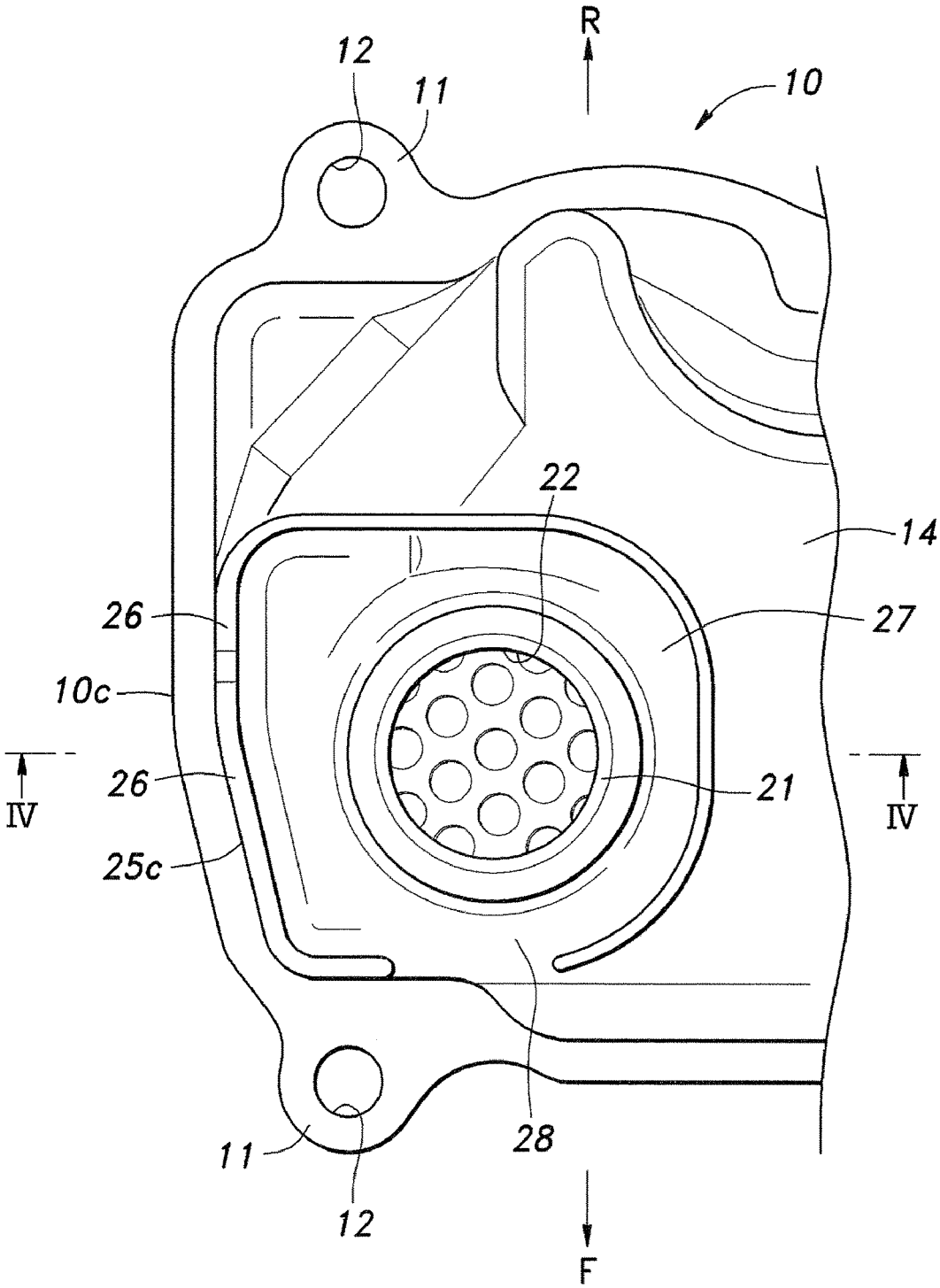
FIG. 3 is an enlarged plan view of an essential part of the head cover according to the embodiment.
Figure 6:
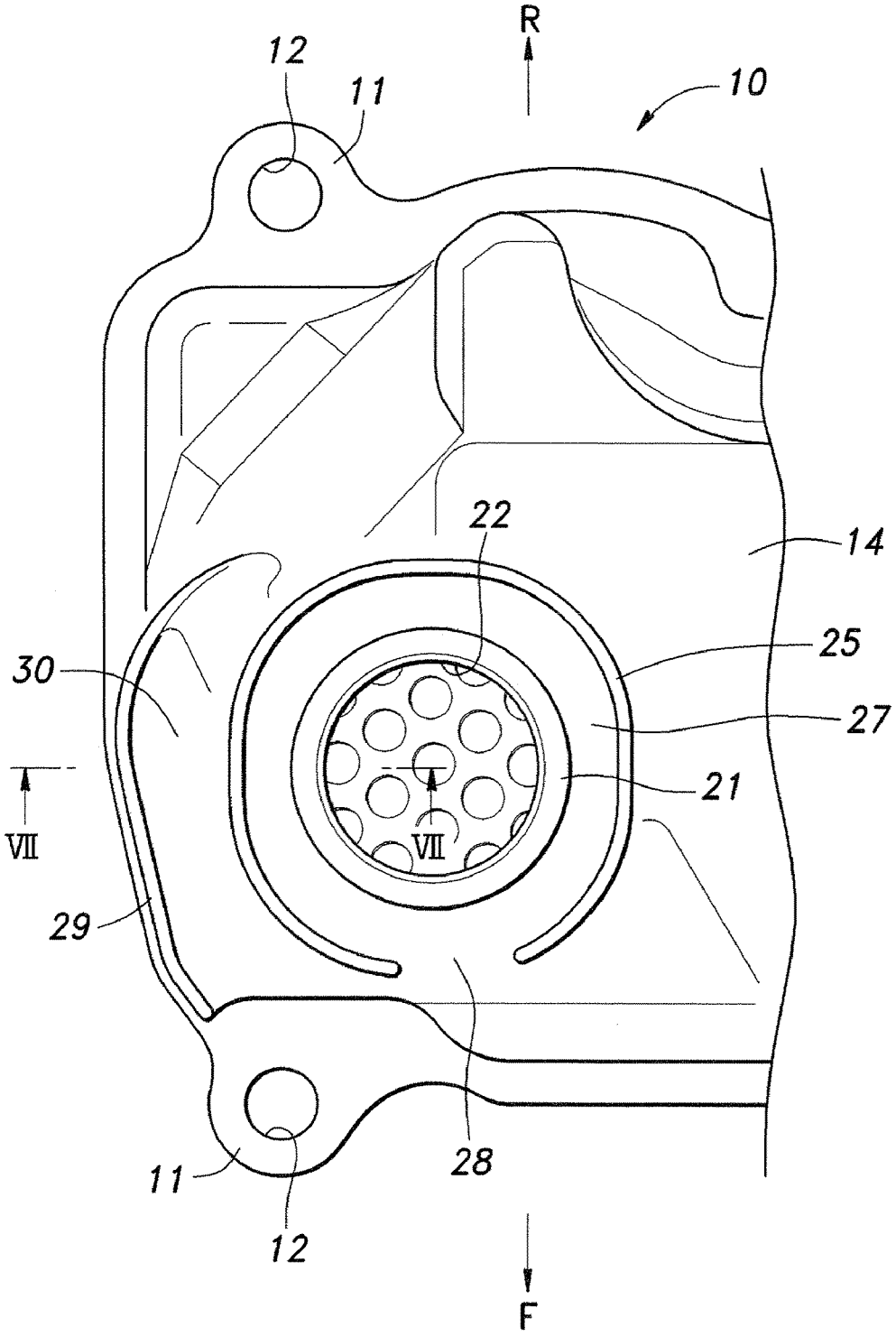
FIG. 6 is an enlarged plan view of an essential part of another embodiment of a head cover according to the present invention.
Figure 7:
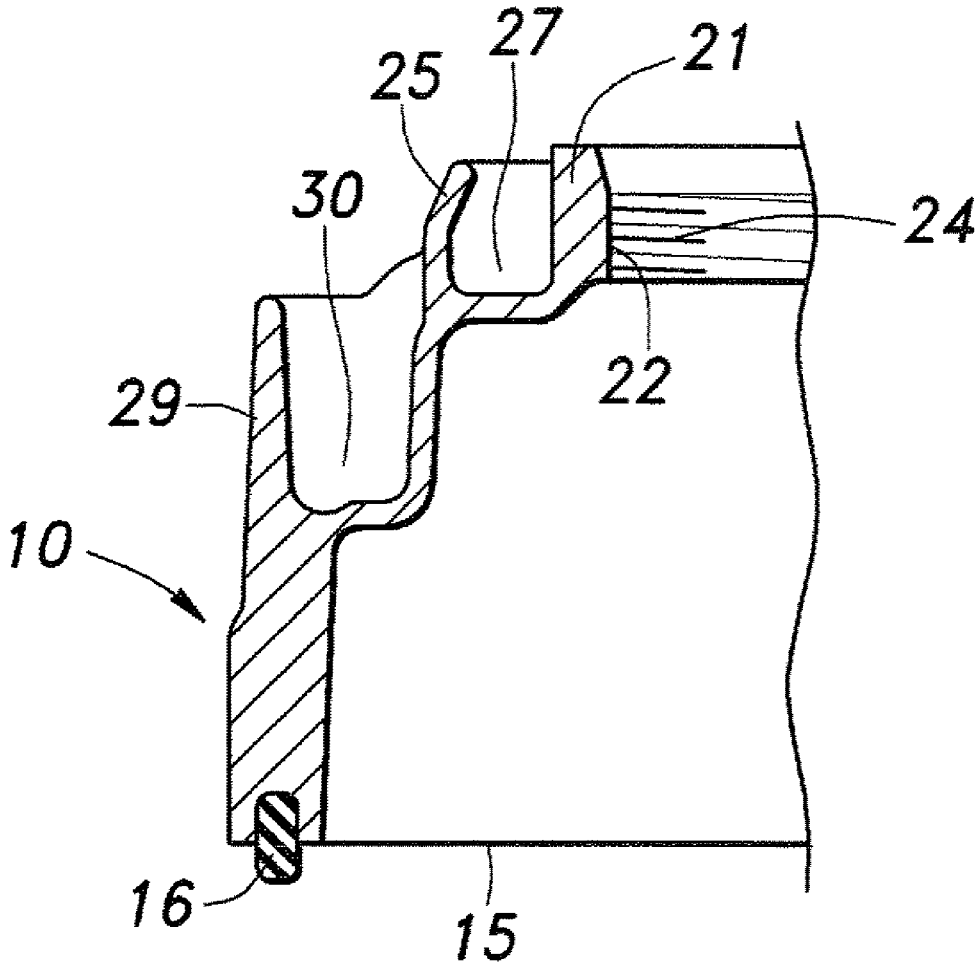
FIG. 7 is cross-sectional view taken along the line VII-VII in FIG. 6.

FIGS. 6 and 7 show another embodiment of the head cover according to the present invention. In FIGS. 6 and 7, component parts corresponding to those in FIGS. 3 and 4 are denoted with the same reference numerals as in FIGS. 3 and 4, and detailed explanation thereof is omitted.

In this embodiment, in addition to the oil outflow prevention wall 25 surrounding the cap attachment boss 21, a protruding rib 29 for reinforcement is integrally formed to the head cover 10 so as to extend along the edge 10C of the head cover 10 in a portion outside of the oil outflow prevention wall 25.

The protruding rib 29 not only contributes to the improvement of rigidity but also serves as an additional oil outflow prevention wall that defines another oil trap portion 30 in the end portion of the head cover 10. This can prevent the outflow of oil to an undesired part even more reliably.

The disclosure of the original Japanese patent application (Japanese Patent Application No. 2007-130265 filed on May 16, 2007) on which the Paris Convention priority claim is made for the present application is hereby incorporated by reference in its entirety.

The invention claimed is:

1. A head cover of an internal combustion engine in which a fastening plane between the head cover and an engine main body is inclined with respect to a horizontal plane when the engine is mounted in a vehicle, the head cover comprising:

a cap attachment boss to which an oil filler cap can be detachably attached, the cap attachment boss having an oil inlet inside thereof; and an oil outflow prevention wall formed around the cap attachment boss, wherein an oil trap portion surrounding the cap attachment boss is defined between the cap attachment boss and the oil outflow preventing wall, and wherein a height of an upper end of the oil outflow prevention wall with respect to the fastening plane is greater in a lower side of the inclination of the fastening plane than in a higher side of the inclination of the fastening plane.

2. The head cover according to claim 1, wherein the height of the upper end of the oil outflow prevention wall with respect to the fastening plane becomes greater toward the lower side of the inclination of the fastening plane.

3. The head cover according to claim 1, wherein the oil outflow prevention wall comprises a part having a greater height than a height of the cap attachment boss in a lower side of the inclination of the fastening plane, and a part having a smaller height than the height of the cap attachment boss in a higher side of the inclination of the fastening plane.

4. The head cover according to claim 1, wherein an upper end surface of the oil outflow prevention wall extends substantially horizontally in an installed state in the vehicle.

5. The head cover according to claim 1, wherein a part of the oil outflow prevention wall is provided with an oil discharge opening.

6. The head cover according to claim 5, wherein a bottom of the oil trap portion is provided with a downward slope toward the oil discharge opening in an installed state in the vehicle.

7. The head cover according to claim 1, wherein the cap attachment boss is formed in a vicinity of one end of the head cover with respect to a crankshaft direction, and the oil outflow prevention wall comprises a part that extends along an edge of the one end of the head cover.

* * * * *